US007204569B2

(12) United States Patent
Walburn

(10) Patent No.: US 7,204,569 B2
(45) Date of Patent: Apr. 17, 2007

(54) ADJUSTABLE DOOR-MOUNTED RACK

(75) Inventor: William L. Walburn, Muncie, IN (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 208 days.

(21) Appl. No.: 10/980,682

(22) Filed: Nov. 3, 2004

(65) Prior Publication Data

US 2006/0091768 A1 May 4, 2006

(51) Int. Cl.
*A47B 57/00* (2006.01)

(52) U.S. Cl. ..... 312/321.5; 108/42; 312/246

(58) Field of Classification Search ..... 312/405.1, 312/321.5, 246, 334.5, 349, 245; 248/224.7, 248/223.31; 211/75, 55, 50.01, 113, 119.004, 211/87.01; 108/152, 153, 42
See application file for complete search history.

(56) References Cited

U.S. PATENT DOCUMENTS 1,433,506 A * 10/1922 Hills ..... 211/105.3
1,543,980 A * 6/1925 Blood ..... 312/290
1,652,677 A 12/1927 McCoy et al.
1,794,327 A 2/1931 Simon
2,122,336 A 6/1938 Berry
2,225,211 A * 12/1940 Erickson ..... 16/402
2,316,389 A 4/1943 Atkinson
2,705,565 A * 4/1955 McKirgan ..... 211/90.04
2,708,147 A * 5/1955 Burke et al. ..... 312/111
3,133,768 A * 5/1964 Klakovich ..... 384/17
3,451,362 A * 6/1969 Welch et al. ..... 108/60
3,634,983 A * 1/1972 Welch ..... 52/27.5
4,260,125 A 4/1981 Levine
5,059,314 A 10/1991 Beckman
5,069,411 A 12/1991 Murphy
5,145,245 A * 9/1992 Fierthaler ..... 312/321.5
5,156,021 A * 10/1992 St-Gelais et al. ..... 62/382
5,309,686 A * 5/1994 Underwood et al. ..... 52/29
5,314,159 A 5/1994 Szarata
5,386,959 A * 2/1995 Laughlin et al. ..... 248/205.1
5,433,414 A 7/1995 Vieira
5,911,395 A 6/1999 Hussaini
6,102,217 A * 8/2000 Mathy et al. ..... 211/85.7
6,666,419 B1 12/2003 Vrame

* cited by examiner

*Primary Examiner*—Janet M. Wilkens
(74) *Attorney, Agent, or Firm*—Brinks Hofer Gilson & Lione

(57) ABSTRACT

An adjustable rack designed for mounting onto a back surface of a cabinet door includes a pair of spaced-apart, generally upright side members having an inside surface and an outside surface. At least one shelf of fixed length extends between the inside surfaces of the side members. At least one channel member is fixed to each of the side members so that at least one end is exposed to a region outside of the outside surface of a side member. The channel members have a pair of grooves in the back surface. A plurality of brackets are provided, each bracket having a pair of flanges received in the pair of grooves in a channel member back surface so that one end of the bracket is exposed from an end of a channel member. Each bracket is selected to have sufficient length to extend from the exposed end of the channel member to the perimeter frame of the door to which the rack is mounted.

13 Claims, 3 Drawing Sheets

ADJUSTABLE DOOR-MOUNTED RACK

BACKGROUND OF THE INVENTION

1. Technical Field

The present invention relates to door-mounted racks useful on cupboard doors having central panels surrounded by perimeter frames to permit mounting of a rack of a given size to doors of a variety of widths.

2. Background Information

Kitchen cabinet doors typically consist of a perimeter frame surrounding a central panel. The central panel is typically formed of thinner material than is the perimeter frame. Typically, the hardware used to pivotally mount the door to the cabinet contacts only the perimeter frame of the door, and avoids any contact with the central panel. Likewise, many door handles on kitchen cabinet doors are mounted to the perimeter frame of the door, and not to the central panel. Often the material forming the central panel is sufficiently thin as to not be able to accept threaded fasteners on one surface without causing visible damage to the opposite surface of the central panel. Further, the central panel is often not sufficiently structurally sound to bear weight loads that might be applied by the contents of any rack mounted to the door.

Racks have been constructed that include telescoping rack bottoms and guard rails and have side supports that expand or contract to fit a variety of sizes of doors. For example, U.S. Pat. No. 2,122,336, to Berry, discloses a spice rack composed of sheet metal elements including a pair of side walls having apertured tabs or ears for receiving fasteners to secure the side walls to the perimeter frame of a cabinet door. A plurality of telescoping sheet metal shelves and bars are coupled to the side walls. The shelves and bars permit sufficient lateral adjustment of the spacing between the side walls to allow the side walls to be mounted to a variety of sizes of cabinet doors. The telescoping character of the shelves and bars contributes to an overall feel of insubstantiality in the resulting rack once mounted to the door. Additionally, the sheet metal construction is esthetically less desirable than a solid wood or molded composite structure of the same general size and character, but having fixed dimensions.

Thus, there remains a need for a rack of generally fixed size that is adapted to be mounted to the back of kitchen cabinet doors of a variety of sizes that avoids any support on the central panel of the door and mounts exclusively to the door perimeter.

BRIEF SUMMARY OF THE INVENTION

An adjustable rack of the present invention is particularly designed for mounting onto the back surface of a cabinet door, but can be employed in a variety of other circumstances. The rack includes a pair of spaced-apart, generally upright side members. Each of the side members has an inside surface and an outside surface. At least one shelf of fixed length extends between the inside surfaces of the side members. The rack also includes at least one channel member fixed to each of the side members. Each channel member has at least one end exposed to a region outside of the outside surface of a side member. The channel members can be integral with or separate from the shelves. The rack also includes a plurality of brackets. Each bracket is received in an exposed end of a channel member. Each bracket is selected to have sufficient length to extend from the exposed end of the channel member in which it is received to the perimeter frame of the door to which the rack is to be mounted.

Each channel member can have two ends extending in opposite directions at least to the outside surfaces of the pair of side members. The channel member can be fixed to a back surface of at least one of the pair of side members. A pair of grooves can be provided in the back surface of each channel member, and a pair of upstanding flanges can be provided in each bracket with the flanges of a given bracket being received in the pair of grooves in a channel member back surface. Each bracket generally has a lateral inner end and a lateral outer end. An eyelet can be provided in the bracket adjacent to the lateral outer end for receiving a fastener. The position of the bracket can be adjusted with respect to the channel member so that the lateral outer end of the bracket can be fastened to the perimeter frame of a door of a variety of sizes.

At least the front surfaces of each of the side members can express a variety of design styles. The shelves can also express a variety of design styles, and can have a solid continuous surface or can have a porous frame-like construction that will allow articles below a selected size to pass through the shelf. A plurality of front guard rails of fixed length can extend between the side members, with each front guard rail being preferably positioned in front of and above one of the plurality of shelves. The resulting rack is of fixed size yet is adapted to be mounted to the back of cabinet doors of a variety of sizes and avoids any support on the central panel of the door mounting exclusively to the door perimeter.

Other features and advantages of the present system will be come apparent from the following description of a preferred embodiment of the present invention, which should be considered in conjunction with the accompanying drawings.

DETAILED DESCRIPTION OF A PREFERRED EMBODIMENT

Figure 1:
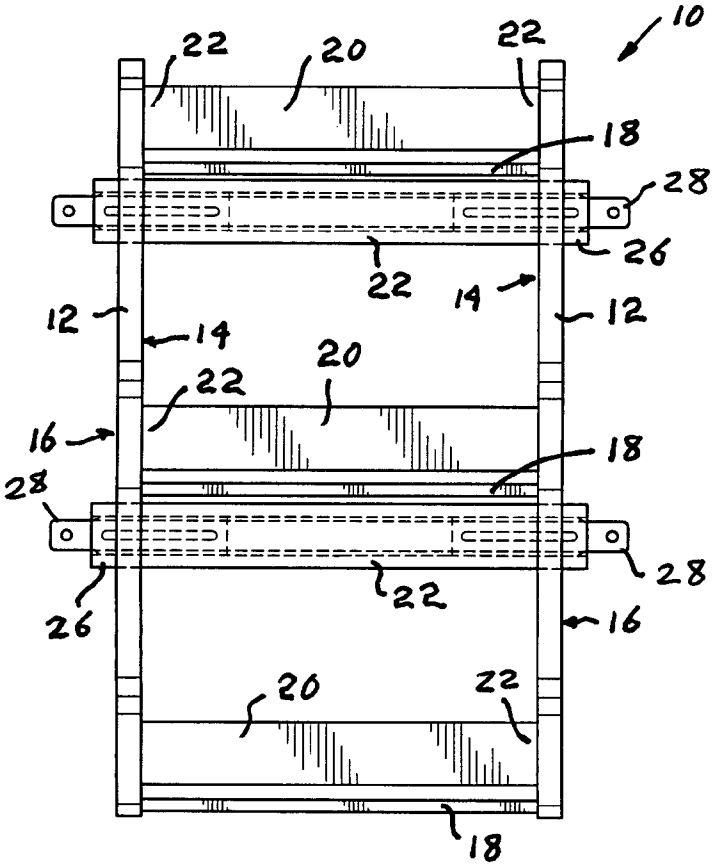
FIG. 1 is a front elevation of an adjustable door-mounted rack of the present invention.
Figure 2:
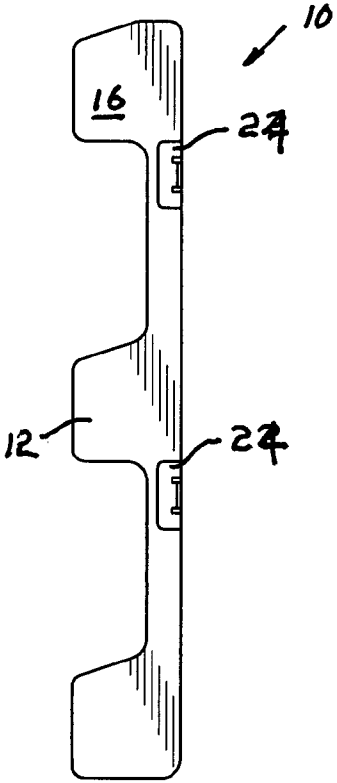
FIG. 2 is a side elevation view of the adjustable door-mounted rack shown in FIG. 1.
Figure 4:
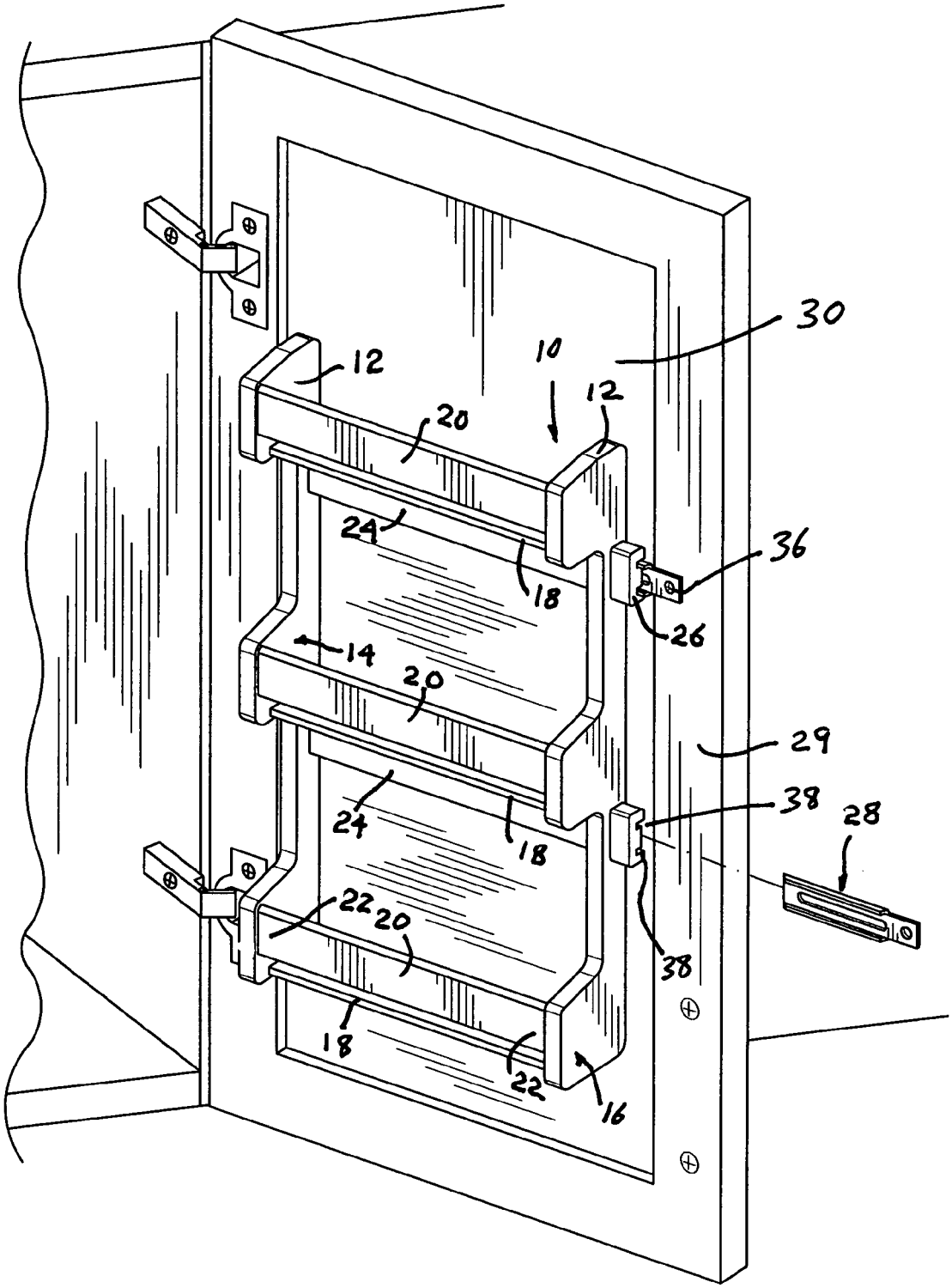
FIG. 4 is a perspective view of the adjustable door-mounted rack of FIGS. 1 to 3 shown attached to a perimeter frame of a cabinet door.

An adjustable rack 10 of the present invention is shown in FIGS. 1, 2 and 4 to have a pair of spaced-apart, generally upright side members 12. Each of the side members 12 has an inside surface 14 and an outside surface 16. A plurality of shelves 18 of fixed length extend between the inside surfaces 14 of the side members 12. A front guard rail 20 having ends 22 can be positioned in front of each of the shelves 18. The ends 22 of the guard rail 20 can be fixed to the side members 12. The front guard rails 20 are designed to inhibit any loss of goods placed on the shelves 18. While the shelves 18 are shown to be solid and separate from the front guard rails 20, it will be appreciated that both structures could be replaced with baskets or trays that include integrally formed portions corresponding to the shelves 18 and front guard rails 20.

An adjustable rack 10 of the present invention also includes one or more channel members 24 that are fixed to the side members 12. The channel members 24 can be integral with or separate from the shelves 18. Each channel member 24 has at least one end 26 exposed to a region outside of the outside surface 16 of a side member 12. Each exposed end 26 can extend beyond the outside surface 16 of the corresponding side member 12. Each channel member 24 can have two ends 26 that are exposed outside both side members 12.

The rack 10 also includes a plurality of brackets 28. The brackets 28 can have the shape shown in FIGS. 5 through 7, or such other shape as will permit suitable interaction with the other portions of the adjustable rack 10. Each bracket 28 can be received in an exposed end 26 of a channel member 24. Each bracket 28 can be selected to have sufficient length L to be adjustable to extend from the exposed end 26 of the channel member 24 in which it is received to the perimeter frame 29 of the door 30 to which the rack 10 is to be mounted as shown particularly in FIG. 4. An eyelet 32 can be provided in the bracket 28 adjacent to a lateral outer end 34 of the bracket 28 to receive a fastener 36 to fasten the lateral outer end 34 to the perimeter frame 29 of the door 30, thus permitting the rack 10 to be fastened to doors 30 of a variety of widths.

Figure 3:
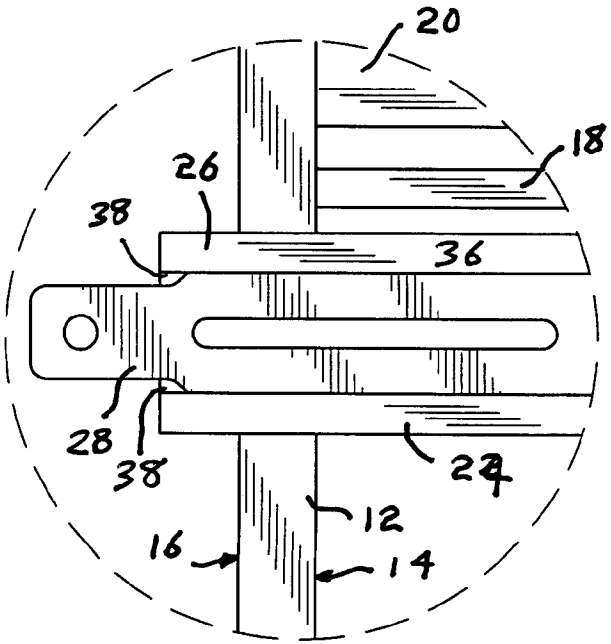
FIG. 3 is a rear elevation detail view of a bracket and channel member of the adjustable door-mounted rack shown in FIGS. 1 and 2.
Figure 6:
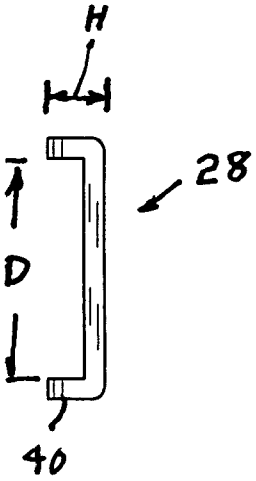
FIG. 6 is an elevation view of the right end of the bracket shown in FIG. 5.
Figure 5:
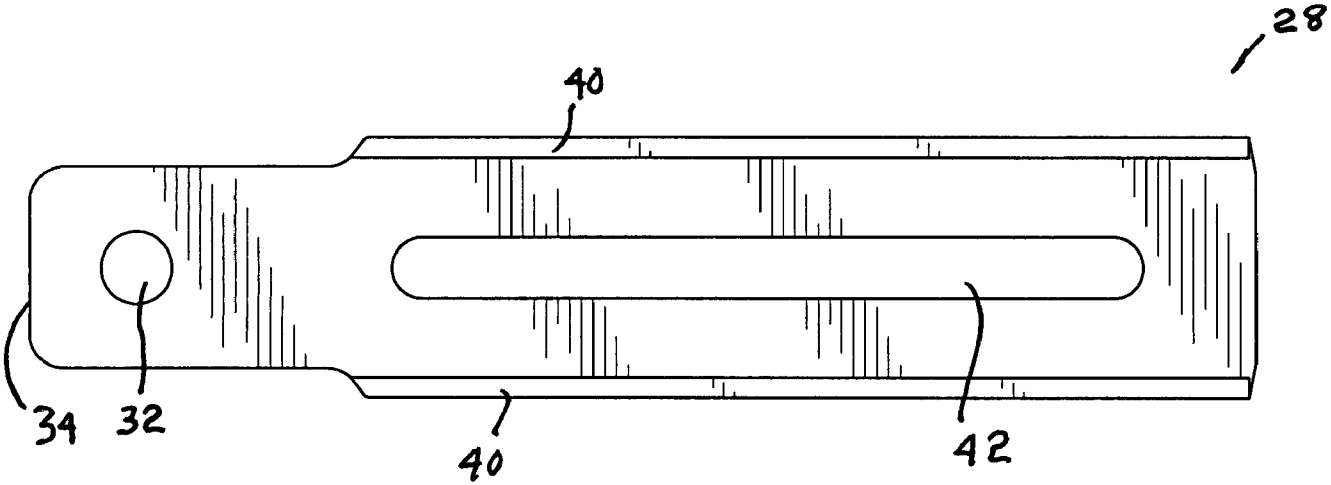
FIG. 5 is a front elevation view of a bracket used in the adjustable door-mounted rack of the present invention.
Figure 7:
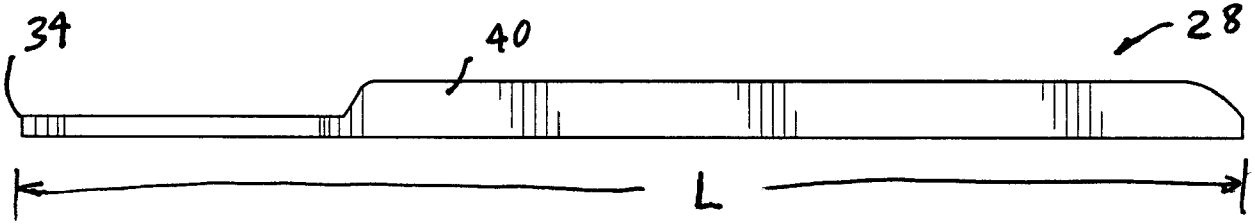
FIG. 7 is a an elevation view of the bottom of FIG. 5.

The channel member 24 can have a back surface 36 that includes grooves 38 as shown in FIG. 3. The bracket 28 can include upstanding flanges 40 shown best in FIGS. 6 and 7 that can be received in the grooves 38. The position of each bracket 28 can be adjusted laterally with respect to the corresponding channel member 24. The bracket 28 can be retained in position merely by friction between the bracket 28 and the corresponding channel member 24. The desired friction between the bracket 28 and the corresponding channel member 24 can be achieved by suitable dimensioning of the grooves 38 and flanges 40. As shown in FIGS. 5-7, the flanges 40 can be confined to only a limited portion of the full length of each bracket 28. The flanges 40 can also be spaced from each other by a distance D that is greater than the height H of flanges. The desired friction can also be supplied by installing a short fastener in the back surface 36 of each channel member 24, the fastener penetrating a slot 42 in the bracket 28.

Other variations will become apparent to those skilled in the art that are still within the scope of the invention as defined in the following claims. The foregoing detailed description should be regarded as merely illustrative rather than limiting, and the following claims, including all equivalents, are intended to define the spirit and scope of this invention.

The invention claimed is:

1. An adjustable rack suitable for mounting to a perimeter frame of a door of a variety of sizes, the rack comprising:

a pair of spaced-apart, upright side members, each side member having an outside surface and an inside surface, a plurality of shelves of fixed length extending between the inside surfaces of the pair of side members, a plurality of channel members fixed to the side members, each channel member having at least one end exposed to a region outside of the outside surface of one of the side members, a back surface of each channel member including a pair of rearwardly opening grooves, and a plurality of brackets, each bracket having a pair of flanges, each flange being received in one of the pair of grooves in the back surface of one of the channel members, each bracket being slidably received in the exposed end of the channel member, each bracket being of sufficient length to span from the exposed end of the channel member to said perimeter frame of the door to which the adjustable rack is to be mounted.

2. The adjustable rack of claim 1 wherein each channel member includes two ends, both ends extending at least to the outside surfaces of the pair of side members.

3. The adjustable rack of claim 1 wherein each channel member has at least one end fixed to the back surface of at least one of the pair of side members.

4. The adjustable rack of claim 1 wherein each bracket has a laterally extending aperture positioned midway between the pair of upstanding flanges.

5. The adjustable rack of claim 1 wherein each bracket has a lateral inner end and a lateral outer end, and includes an eyelet formed adjacent to the lateral outer end for receiving a fastener for fastening the lateral outer end to said perimeter frame.

6. The adjustable rack of any of claims 1, 2, 3, 4, or 5 further comprising a plurality of front guard rails of fixed length extending between the side members, each front guard rail being positioned in front of and above one of the plurality of shelves.

7. An adjustable rack suitable for mounting to a perimeter frame of a door of a variety of sizes, the rack comprising:

a pair of spaced-apart, upright side members, each side member having an outside surface and an inside surface, at least one shelf of fixed length extending between the inside surfaces of the pair of side members, at least one channel member fixed to each of the side members, each channel member having at least one end exposed to a region outside of the outside surface of one of the side members, a back surface of each channel member including a pair of rearwardly opening grooves, and a plurality of brackets, each bracket having a pair of flanges, each bracket being received in the exposed end of one of the channel members such that each flange is received in one of the pair of grooves, each bracket being of sufficient length to span from the exposed end of the channel member to said perimeter frame of the door to which the adjustable rack is to be mounted.

8. The adjustable rack of claim 7 wherein each channel member is vertically spaced from all of the shelves.

9. The adjustable rack of claim 7 or 8 wherein each channel member includes a surface frictionally engaging one of the brackets to inhibit any lateral displacement of the shelf during any opening or closing motion of the door.

10. The adjustable rack of claim 9 wherein each bracket has an inner end and an outer end, and includes an eyelet formed adjacent to the outer end for receiving a fastener fastening the outer end to said perimeter frame.

11. The adjustable rack of claim 9 wherein each channel member includes two ends, both ends extending at least to the outside surfaces of the pair of side members, each channel member being secured to the back surface of the pair of side members.

12. The adjustable rack of claim 11 wherein each shelf has a lateral dimension, measured between the side members, exceeding any other orthogonally related dimension of the shelf.

13. The adjustable rack of claim 12 wherein each shelf has a solid continuous surface that is horizontally arranged and includes a back edge spaced from the back surface of the pair of side members.

* * * * *